US005788070A

United States Patent [19]

Banker

[11] Patent Number: 5,788,070

[45] Date of Patent: Aug. 4, 1998

[54] GOLF EQUIPMENT STORAGE DEVICE

[76] Inventor: Robert K. Banker, 7109 Owls Clover Way, Roseville, Calif. 95747

[21] Appl. No.: 873,939

[22] Filed: Jun. 12, 1997

[51] Int. Cl.[6] ..... A47B 81/00

[52] U.S. Cl. ..... 206/315.2; 70/78; 220/501; 312/300

[58] Field of Search ..... 70/63, 76, 78–80; 206/315.1, 315.2, 579; 220/501, 503, 520; 312/199–201, 216, 249.7, 298–300, 304, 308, 309, 324, 325, 327

[56] References Cited

U.S. PATENT DOCUMENTS

| | | | |
|---|---|---|---|
| 664,697 | 12/1900 | Walpuski | 312/199 |
| 1,179,017 | 4/1916 | McVicker | 312/300 |
| 1,369,577 | 2/1921 | Townley | 312/199 |
| 2,875,010 | 2/1959 | Sola et al. | 312/200 |
| 3,786,915 | 1/1974 | Potts et al. | 206/315.2 |
| 4,344,660 | 8/1982 | Molnar et al. | 312/324 |

*Primary Examiner*—Jimmy G. Foster

[57] ABSTRACT

A new golf equipment storage device for securing to a golf cart for safe storage of golf clubs and golfing accessories. The inventive device includes a storage container having a lower portion and an upper portion. The upper portion is hingedly coupled with the lower portion. The upper portion and the lower portion each have an open front, a closed back and opposed side walls. The upper portion has a top wall. The lower portion has a bottom wall. The lower portion has a pair of compartments for two sets of golf clubs. A pair of upper and lower doors are coupled with the upper and lower portions of the storage container. A locking system is adapted for locking the upper and lower doors against the storage container.

8 Claims, 2 Drawing Sheets

GOLF EQUIPMENT STORAGE DEVICE

BACKGROUND OF THE INVENTION

1. Field of the Invention

The present invention relates to golf cart attachments and more particularly pertains to a new golf equipment storage device for securing to a golf cart for safe storage of gold clubs and golfing accessories.

2. Description of the Prior Art

The use of golf cart attachments is known in the prior art. More specifically, golf cart attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf cart attachments include U.S. Pat. No. 5,094,500 to Maypole et al.; U.S. Pat. No. 5,052,604 to Tourangeau; U.S. Pat. No. 4,355,746 to Casady; U.S. Pat. No. Des. 320,580 to Kim; U.S. Pat. No. 4,533,013 to Hightower; and U.S. Pat. No. 5,178,444 to May et al.

While these devices fulfill their respective, particular objectives and requirements, the aforementioned patents do not disclose a new golf equipment storage device. The inventive device includes a storage container having a lower portion and an upper portion. The upper portion is hingedly coupled with the lower portion. The upper portion and the lower portion each have an open front, a closed back and opposed side walls. The upper portion has a top wall. The lower portion has a bottom wall. The lower portion has a pair of compartments for two sets of golf clubs. A pair of upper and lower doors are coupled with the upper and lower portions of the storage container. A locking system is adapted for locking the upper and lower doors against the storage container.

In these respects, the golf equipment storage device according to the present invention substantially departs from the conventional concepts and designs of the prior art, and in so doing provides an apparatus primarily developed for the purpose of securing to a golf cart for safe storage of golf clubs and golfing accessories.

SUMMARY OF THE INVENTION

In view of the foregoing disadvantages inherent in the known types of golf cart attachments now present in the prior art, the present invention provides a new golf equipment storage device construction wherein the same can be utilized for securing to a golf cart for safe storage of golf clubs and golfing accessories.

The general purpose of the present invention, which will be described subsequently in greater detail, is to provide a new golf equipment storage device apparatus and method which has many of the advantages of the golf cart attachments mentioned heretofore and many novel features that result in a new golf equipment storage device which is not anticipated, rendered obvious, suggested, or even implied by any of the prior art golf cart attachments, either alone or in any combination thereof.

To attain this, the present invention generally comprises a storage container having a generally rectangular configuration. The container has a lower portion and an upper portion. The upper portion is hingedly coupled with the lower portion. The upper portion and the lower portion each have an open front, a closed back and opposed side walls. The upper portion has a top wall. The lower portion has a bottom wall. The upper portion has a height about ⅓ of a height of the lower portion. The upper portion and the lower portion each include a central divider extending between the top wall and the bottom wall for receiving two sets of golf clubs. The central divider parallels the opposed side walls. The lower portion includes forward divider walls disposed on opposing sides of the central divider positioned inwardly of the open front thereof. The lower portion includes a pair of upper and lower shelves disposed on opposing sides of the central divider forwardly of the forward divider walls. The lower portion includes a pair of bottom shelves disposed on opposing sides of the central divider forwardly of the forward divider walls. A pair of upper and lower doors are included. The pair of upper doors are hingedly secured to forward edges of the open front of the upper portion. Each upper door has a knob disposed on a lower interior portion thereof. The pair of lower doors are hingedly secured to forward edges of the open front of the lower portion. Each lower door has a knob disposed on an upper interior portion thereof. A locking system including a pair of hasps is secured to forward edges of the central divider of the upper and lower portions. The hasps extend outwardly from the central divider beyond the pair of upper and lower doors when in a closed orientation. A circular locking disk has a central opening therethrough for receiving the pair of hasps therethrough. The circular locking disk abuts each of the doors. A padlock couples with the pair of hasps.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new golf equipment storage device apparatus and method which has many of the advantages of the golf cart attachments mentioned heretofore and many novel features that result in a new golf equipment storage device which is not anticipated, rendered obvious, suggested, or even implied by any of the prior art golf cart attachments, either alone or in any combination thereof.

It is another object of the present invention to provide a new golf equipment storage device which may be easily and efficiently manufactured and marketed.

It is a further object of the present invention to provide a new golf equipment storage device which is of a durable and reliable construction.

An even further object of the present invention is to provide a new golf equipment storage device which is susceptible of a low cost of manufacture with regard to both materials and labor, and which accordingly is then susceptible of low prices of sale to the consuming public, thereby making such golf equipment storage device economically available to the buying public.

Still yet another object of the present invention is to provide a new golf equipment storage device which provides in the apparatuses and methods of the prior art some of the advantages thereof, while simultaneously overcoming some of the disadvantages normally associated therewith.

Still another object of the present invention is to provide a new golf equipment storage device for securing to a golf cart for safe storage of golf clubs and golfing accessories.

Yet another object of the present invention is to provide a new golf equipment storage device which includes a storage container having a lower portion and an upper portion. The upper portion is hingedly coupled with the lower portion. The upper portion and the lower portion each have an open front, a closed back and opposed side walls. The upper portion has a top wall. The lower portion has a bottom wall. The lower portion has a pair of compartments for two sets of golf clubs. A pair of upper and lower doors are coupled with the upper and lower portions of the storage container. A locking system is adapted for locking the upper and lower doors against the storage container.

Still yet another object of the present invention is to provide a new golf equipment storage device that is a permanent locker for golf clubs and equipment for a motorized golf cart.

Even still another object of the present invention is to provide a new golf equipment storage device that provides storage for all clubs and equipment for two golfers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
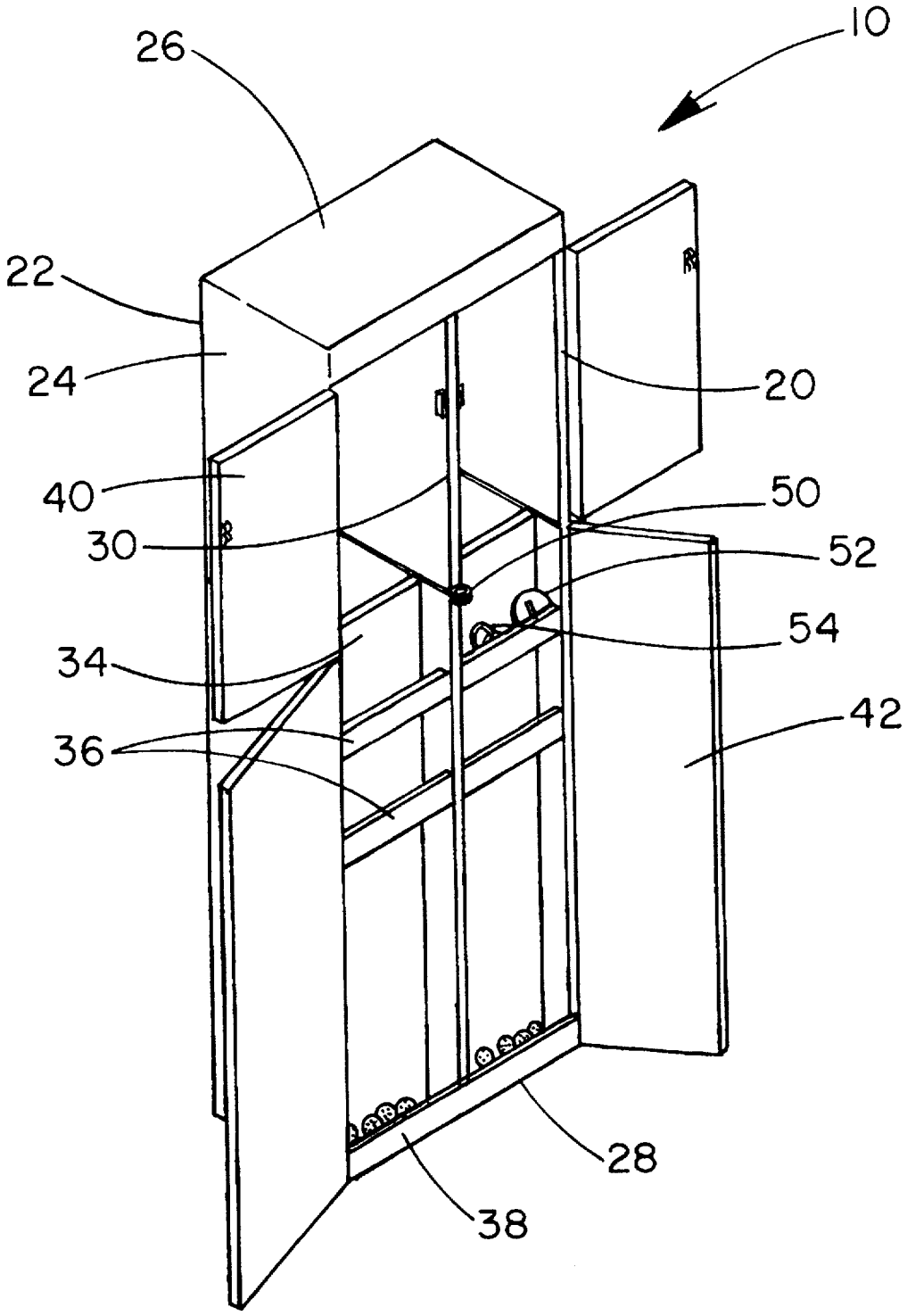
FIG. 1 is a perspective view of a new golf equipment storage device according to the present invention.
Figure 2:
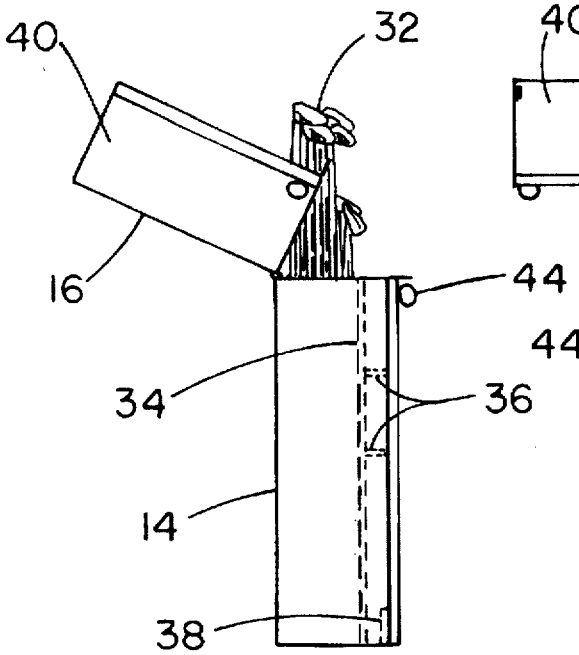
FIG. 2 is a side elevation view of the present invention.
Figure 2A:
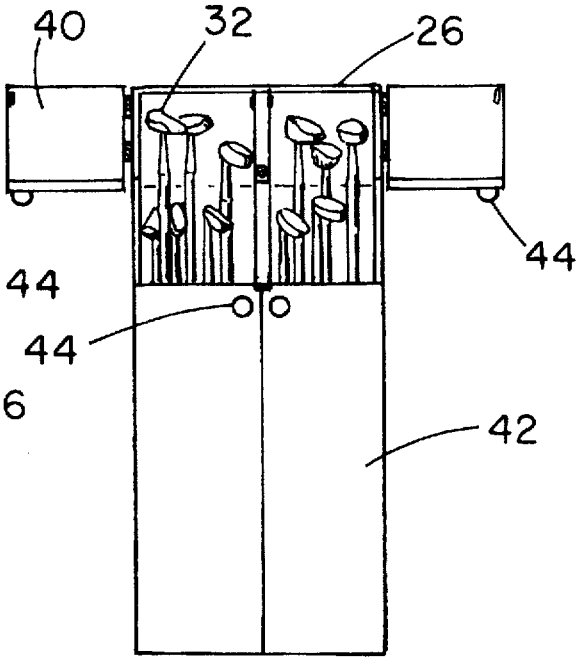
FIG. 2A is a front elevation view of the present invention.
Figure 3:
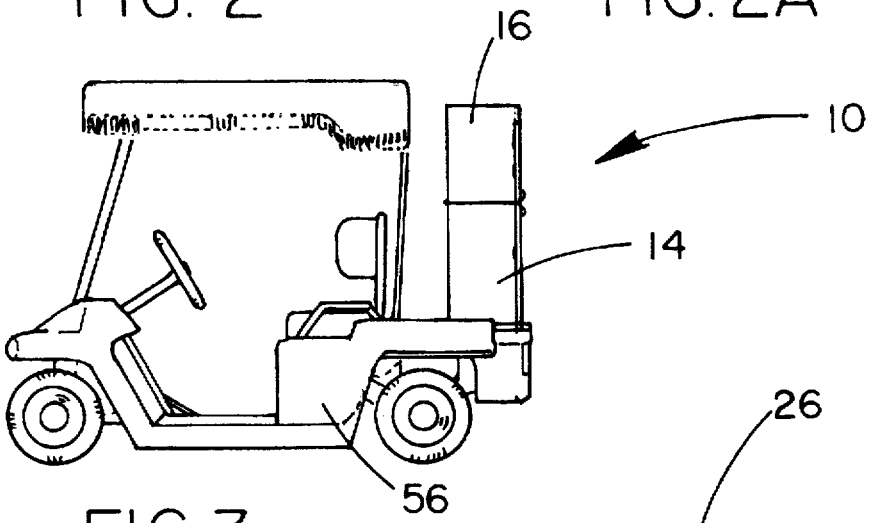
FIG. 3 is side view of the present invention illustrated coupled with a golf cart.
Figure 4:
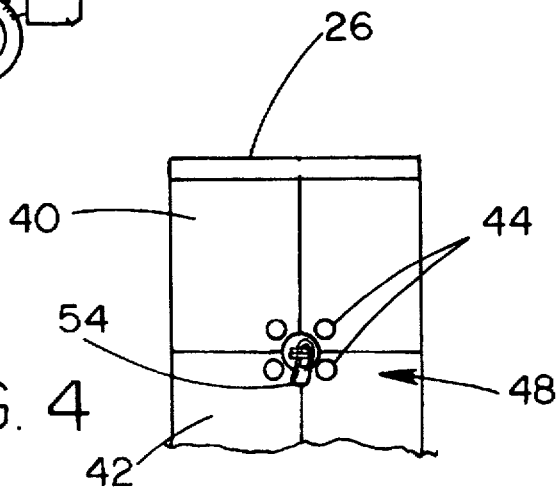
FIG. 4 is a partial front view of the present invention illustrated in a locked orientation.

With reference now to the drawings, and in particular to FIGS. 1 through 4 thereof, a new golf equipment storage device embodying the principles and concepts of the present invention and generally designated by the reference numeral 10 will be described.

As best illustrated in FIGS. 1 through 6, the golf equipment storage device 10 comprises a storage container 12 having a generally rectangular configuration. The container 12 has a lower portion 14 and an upper portion 16. The upper portion 16 is hingedly coupled with the lower portion 14. The upper portion 16 and the lower portion 14 each have an open front 20, a closed back 22 and opposed side walls 24. The upper portion 16 has a top wall 26. The lower portion 14 has a bottom wall 28. The upper portion 16 has a height about ⅓ of a height of the lower portion 14. The upper portion 16 and the lower portion 14 each include a central divider 30 extending between the top wall 26 and the bottom wall 28 for receiving two sets of golf clubs 32. The central divider 30 parallels the opposed side walls 24. The lower portion 14 includes forward divider walls 34 disposed on opposing sides of the central divider 30 positioned inwardly of the open front 20 thereof. The lower portion 14 includes a pair of upper and lower shelves 36 disposed on opposing sides of the central divider 30 forwardly of the forward divider walls 34. The lower portion 14 includes a pair of bottom shelves 38 disposed on opposing sides of the central divider 30 forwardly of the forward divider walls 34.

A pair of upper 40 and lower doors 42 are included. The pair of upper doors 40 are hingedly secured to forward edges of the open front 20 of the upper portion 16. Each upper door 40 has a knob 44 disposed on a lower interior portion thereof. The pair of lower doors 42 are hingedly secured to forward edges of the open front 20 of the lower portion 14. Each lower door 42 has a knob 44 disposed on an upper interior portion thereof.

A locking system 48 including a pair of hasps 50 is secured to forward edges of the central divider 30 of the upper 16 and lower portions 14. The hasps 50 extend outwardly from the central divider 30 beyond the pair of upper 40 and lower doors 42 when in a closed orientation. A circular locking disk 52 has a central opening therethrough for receiving the pair of hasps 50 therethrough. The circular locking disk 52 abuts each of the doors 40,44. A padlock 54 couples with the pair of hasps 50.

In use, the container 12 is divided into two sides, providing storage for all clubs and equipment for two golfers. Each side would incorporate a rear section that would vertically house protective golf club storage tubes. Storage shelves are provided in front of the club tube area for equipment such as golf balls, tees, gloves and shoes. A hinged upper portion 16 over both storage sides would provide access to clubs, and doors 40,42 hinged to open to the sides would allow access to the storage shelves. The lock assembly 48 on the upper portion 16 and the lower portion 14 where the four doors meet is designed so that the container 12 can be locked with a single padlock 54. The container 12 is dimensioned for securement to the rear of a golf cart 56 where golf bags would normally be attached via bag straps. This device 10 is particularly attractive for those golfers who own their own golf carts whereby the device 10 could be permanently secured to the golf cart.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf equipment storage device comprising, in combination:

a storage container having a generally rectangular configuration, the container having a lower portion and an upper portion, the upper portion being hingedly coupled with the lower portion, the upper portion and the lower portion each having an open front, a closed back and opposed side walls, the upper portion having a top wall, the lower portion having a bottom wall, the upper portion having a height about ⅓ of a height of the lower portion, the upper portion and the lower portion each including a central divider extending between the top wall and the bottom wall for receiving two sets of golf clubs, the central divider paralleling the opposed side walls, the lower portion including forward divider walls disposed on opposing sides of the central divider positioned inwardly of the open front thereof, the lower portion including a pair of upper and lower shelves disposed on opposing sides of the central divider forwardly of the forward divider walls, the lower portion including a pair of bottom shelves disposed on opposing sides of the central divider forwardly of the forward divider walls;

a pair of upper and lower doors, the pair of upper doors hingedly secured to forward edges of the open front of the upper portion, each upper door having a knob disposed on a lower interior portion thereof, the pair of lower doors hingedly secured to forward edges of the open front of the lower portion, each lower door having a knob disposed on an upper interior portion thereof; and a locking system including a pair of hasps secured to forward edges of the central divider of the upper and lower portions, the hasps extending outwardly from the central divider beyond the pair of upper and lower doors when in a closed orientation, a circular locking disk having a central opening therethrough for receiving the pair of hasps therethrough, the circular locking disk abutting each of the doors, a padlock coupling with the pair of hasps.

2. A golf equipment storage device comprising, in combination:

a storage container having a lower portion and an upper portion, the upper portion being hingedly coupled with the lower portion, the upper portion and the lower portion each having an open front, a closed back and opposed side walls, the upper portion having a top wall, the lower portion having a bottom wall, the lower portion having a pair of compartments for two sets of golf clubs;

a pair of upper and lower doors coupled with the upper and lower portions of the storage container; and a locking system adapted for locking the upper and lower doors against the storage container.

3. The golf equipment storage device as set forth in claim 2 wherein the locking system includes a pair of hasps secured to forward edges the upper and lower portions, the hasps extending outwardly beyond the pair of upper and lower doors when in a closed orientation, a circular locking disk having a central opening therethrough for receiving the pair of hasps therethrough, the circular locking disk abutting each of the doors, a padlock coupling with the pair of hasps.

4. The golf equipment storage device as set forth in claim 2 wherein the upper portion has a height about ⅓ of a height of the lower portion.

5. The golf equipment storage device as set forth in claim 2 wherein the upper portion and the lower portion each include a central divider extending between the top wall and the bottom wall for receiving the two sets of golf clubs, the central divider paralleling the opposed side walls.

6. The golf equipment storage device as set forth in claim 5 wherein the lower portion includes forward divider walls disposed on opposing sides of the central divider positioned inwardly of the open front thereof.

7. The golf equipment storage device as set forth in claim 5 wherein the lower portion includes a pair of upper and lower shelves disposed on opposing sides of the central divider forwardly of the forward divider walls.

8. The golf equipment storage device as set forth in claim 5 wherein the lower portion includes a pair of bottom shelves disposed on opposing sides of the central divider forwardly of the forward divider walls.

* * * * *